United States Patent [19]

MacDougall

[11] 4,261,566

[45] Apr. 14, 1981

[54] GOLF CLUBS

[76] Inventor: Ian C. MacDougall, 19 Knockbreck Ave., Tain, Rosshire, Scotland

[21] Appl. No.: 854,089

[22] Filed: Nov. 23, 1977

[30] Foreign Application Priority Data

Nov. 30, 1976 [GB] United Kingdom ..... 49977/76

[51] Int. Cl.[3] ..... A63B 53/00

[52] U.S. Cl. ..... 273/77 A; 73/65

[58] Field of Search ..... 273/77 R, 77 A, 80 R, 273/80 B, 183 R, 186 R, 186 A; 35/29 A

[56] References Cited

U.S. PATENT DOCUMENTS

| | | | |
|---|---|---|---|
| 1,516,786 | 11/1924 | Prentiss | 273/77 A |
| 2,822,174 | 2/1958 | Brandon | 273/77 A X |
| 3,625,513 | 12/1971 | Ballmer | 273/77 A X |
| 3,698,239 | 10/1972 | Everett | 273/77 A X |
| 3,792,863 | 2/1974 | Evans | 273/77 R X |
| 3,871,649 | 3/1975 | Kilshaw | 273/77 A |
| 3,963,236 | 6/1976 | Mann | 273/77 A |
| 4,058,312 | 11/1977 | Stuff et al. | 273/77 A |
| 4,070,022 | 1/1978 | Braly | 273/77 A |
| 4,082,277 | 4/1978 | Van Auken et al. | 273/80 R |
| 4,128,242 | 12/1978 | Elkins | 273/77 A |

FOREIGN PATENT DOCUMENTS 1220804 1/1971 United Kingdom ..... 273/77 A

OTHER PUBLICATIONS

"Golf Digest"; Mar. 1972; p. 10.

"The Search for the Perfect Swing", by Cochran and Stobbs, 1968; pp. 4,22,23,209–217,219–222, and 225–230.

"Kenneth Smith Golf Clubs", 1969, pp. 10,14–16, and 25.

*Primary Examiner*—Richard J. Apley

*Attorney, Agent, or Firm*—Frailey & Ratner

[57] ABSTRACT

The invention comprises a set of golf clubs designed to suit a particular swing, each golf cluf of the set having an effective length and a total weight, wherein the product of the effective length and total weight is substantially the same for each club in the set, and wherein the clubs of the set each have a shaft incorporating a stiffness factor differing from club to club and functionally related to the speed of the swing of the club. The invention also includes the method and apparatus for manufacturing the golf clubs of which the set of clubs is constituted.

9 Claims, 8 Drawing Figures

| CLUB | LE INCH | WEIGHT OZS. | MS1 OZ. IN. | MS OZ. IN. | LCG INCH | K lb/INCH |
|---|---|---|---|---|---|---|
| DRIVER | 39·34 | 12·84 | 505 | 327 | 25·47 | ·896 |
| 3 WOOD | 37·85 | 13·34 | 505 | 337 | 25·23 | ·969 |
| 4 WOOD | 37·16 | 13·59 | 505 | 341 | 25·10 | 1·000 |
| 3 IRON | 34·56 | 14·61 | 505 | 349 | 23·92 | 1·128 |
| 4 IRON | 33·97 | 14·87 | 505 | 353 | 23·77 | 1·165 |
| 5 IRON | 33·41 | 15·12 | 505 | 356 | 23·61 | 1·199 |
| 6 IRON | 32·87 | 15·37 | 505 | 360 | 23·45 | 1·234 |
| 7 IRON | 32·35 | 15·61 | 505 | 364 | 23·29 | 1·268 |
| 8 IRON | 31·85 | 15·85 | 505 | 367 | 23·13 | 1·302 |
| 9 IRON | 31·36 | 16·10 | 505 | 370 | 22·96 | 1·336 |
| P/W & S/I | 30·89 | 16·35 | 505 | 373 | 22·79 | 1·370 |

| CLUB | LE INCH | WEIGHT OZS. | MS1 OZ. IN. | MS OZ. IN. | LCG INCH | K lb/INCH |
|---|---|---|---|---|---|---|
| DRIVER | 39·34 | 12·84 | 505 | 327 | 25·47 | ·896 |
| 3 WOOD | 37·85 | 13·34 | 505 | 337 | 25·23 | ·969 |
| 4 WOOD | 37·16 | 13·59 | 505 | 341 | 25·10 | 1·000 |
| 3 IRON | 34·56 | 14·61 | 505 | 349 | 23·92 | 1·128 |
| 4 IRON | 33·97 | 14·87 | 505 | 353 | 23·77 | 1·165 |
| 5 IRON | 33·41 | 15·12 | 505 | 356 | 23·61 | 1·199 |
| 6 IRON | 32·87 | 15·37 | 505 | 360 | 23·45 | 1·234 |
| 7 IRON | 32·35 | 15·61 | 505 | 364 | 23·29 | 1·268 |
| 8 IRON | 31·85 | 15·85 | 505 | 367 | 23·13 | 1·302 |
| 9 IRON | 31·36 | 16·10 | 505 | 370 | 22·96 | 1·336 |
| P/W & S/I | 30·89 | 16·35 | 505 | 373 | 22·79 | 1·370 |

GOLF CLUBS

This invention relates to golf club manufacture and more particularly is concerned with golf club calibration and the matching of club to club and club to player. The invention is also concerned with the design of a set of clubs or club to the specific requirements of an individual but can also be used in the volume production of clubs.

The golf trade, by which is meant golf club manufacturers, retailers, users and golf professionals have long been interested in club matching and a great deal of work and effort has been spent on the subject. Much less effort has been devoted to identifying the specific relationships between player and club and the evaluations tend to fall into the general category of 'Slow Swinger-Whippy Shaft:Fast Swinger-Stiff Shaft'. Moreover, the provision by shaft manufacturers of shafts calibrated as so-called 'L'-Whippy to 'X'-extra stiff and the most recent introduction of shafts made from more exotic materials such as special alloy steels and carbon fibre have done little to improve upon the generalisation associated with shaft selection.

There is thus a need for a method of calibrating clubs and associated method of matching not only club to club but player to club and, moreover, a method which can be used by the majority of manufacturers, not only large companies but small and medium sized companies, as well as the pro-golfer in his day to day sales.

An object of the invention is to provide an improved method of calibrating clubs and a method of matching club to club and player to club. A further object of the invention is to provide apparatus for use in calibrating golf clubs according to the method.

Accordingly a first aspect of the invention comprises a set of golf clubs designed to suit a particular swing, said golf clubs each having an effective length and a total weight and wherein the product of said effective length and said total weight is substantially the same for each club in the set, said golf clubs further comprising shafts having a stiffness factor differing from club to club and wherein said stiffness factor is mathematically functionally related to the speed of said swing. By 'effective length' of a golf club is meant the overall length of the club minus four inches. The stiffness of the shafts permits each shaft to return to substantially straight condition from a condition of maximum shaft deflection in the time it takes the shaft, during a downswing, to go from the position of maximum position to impact position.

A further aspect of the invention comprises apparatus for use in the manufacture of golf clubs, said golf clubs each having an effective length and a total weight, said apparatus comprising a knife edge adapted to support a golf club at a first point adjacent the grip portion thereof, a retaining member adapted to act on said golf club at a second point nearer to the butt end of said grip portion than said first point and wherein said knife edge support is mounted on a lever arm supported on a fulcrum and having a weight slidable thereon so as to vary and provide a direct measurement of the static moment exerted by a golf club placed in said apparatus, said lever arm including a sliding scale and a fixed scale whereby the product of said effective length and said total weight may be obtained.

In analysing a golf swing certain criteria may be established by observation and these include the fact that the golf club shaft flexes and reflexes during the swing and each individual has a natural rhythm. Further it may be observed that there is a discernible difference between the shape or geometry of the swings of highly competent and not so competent players. Moreover, there are observable and measurable physical characteristics of a player which relate directly to the golf club and indicate that clubs of a particular length and lie angle together with particular weights are more suitable to one player than another.

The present invention seeks to calibrate clubs and to relate more directly the physical characteristics of the player to his clubs. By taking into consideration physical characteristics of the player such as shoulder width and arm length and by associating these with an appropriate club length, a swing geometry or pattern can be produced using graphs of arm and club angles. These graphs can be used to facilitate the practice of the invention and show a spread of rate of change of angle which is related to the degree of competence of the golfer ranging from class 1—highly competent, say a professional or top class amateur, to class 4—a beginner. The criteria relating class of player is reflected in the geometry or swing pattern which therefore offers a visual check on the category in which a player should be classified. Speed and direction of swing are related within the class of geometry being analysed. Class 1 geometry is closely controlled and highly efficient, class 4 geometry is much less controlled and much less efficient when measured over the same period of elapsed time from the top of the swing to impact.

The swing geometry can be further analysed by considering the clubhead movement, both linear and angular and dividing the swing into say ten unit increments of equal time elapse. For convenience each increment can be considered as an arc of a circle so that both the acceleration and instantaneous velocities at the end of each increment can be approximated and, by inclusion of the effective club mass or effective cantilever mass in the calculations, the forces acting at the clubhead both tangential to the arc of the downswing and centripetal to the centroid of the arc can be found and tabulated. Some of the tangential forces at the commencement of the downswing act negatively, that is, opposite to the direction of the downswing and since these negative forces decelerate the clubhead but do not reverse the direction of the swing it may be taken that they have the effect of negatively flexing the shaft. It can also be shown that when these tangential and centripetal force components are resolved, the resultant force is seen to be common to the two component forces acting on the club, namely one force tangential to the sub-arc centred at the grip point on the shaft and one force centripetal to that centre point and on the axis of the shaft. The resolution of forces acting on golf clubs has been dealt with adequately in other texts and it is not proposed to further describe this procedure. It should be noted, however, that the effective club mass or the effective cantilever mass referred to above is taken to mean in this specification and the accompanying claims the weight of the club head plus a fraction of the shaft weight divided by the gravitational constant 'g' ft. per $sec^2$. This fraction of the shaft weight may vary somewhat in usage, however, for the purposes of the present invention it has been assumed to be 0.24 times the shaft weight. In other words it has been assumed that the effective mass of a golf club comprises the mass of the club head plus 0.24 times the mass of the shaft.

The golf swing comprises four discernible phases relative to impact, that is, (1) address, (2) backswing, (3) downswing and (4) follow through. The focus of this analysis is on the downswing which is an on-going continuous forward swing, however, within this continuous forward swing the shaft is subjected to the above mentioned force reversals tending to vibrate the shaft in a flexing/reflexing manner.

An important aspect behind this invention lies in the belief that superimposed on all these individual flexing-/reflexing movements an overall vibration tends to develop which, however, is taken off just at or before impact. The deflection of the shaft, visible using photographic methods, constitutes part of this overall vibration and it is concluded that for optimum results it is necessary for the shaft to recover from a position of maximum deflection to a straight position in the time it takes the golfer to go from the position at which the maximum deflection occurs to the impact position. Moreover, it has been found in studying golf swings that this time period of recovery is a quarter of the period of the overall vibration. In other words if 't' secs. is the time from the position of maximum deflection to impact and 'T' secs. is the period of the overall vibration, which has a frequency f, then $t=(T/4)$ and the time elapsing (Te) from the top of the swing to impact (hereinafter and in the appended claims referred to as "the downswing") is equal to this time period T. This discovery has very important consequences as it allows a direct relationship to be established between the player and the club and the establishment of this relationship between the player and his club allows the evaluation of the required shaft stiffness factor using frequency equations in either linear or angular form, such as $k=4\pi^2f^2 m$ or $k=\omega fr^2m$. Where 'k' is the stiffness factor of the shaft, 'f' is the frequency of the swing referred to herein as the linear frequency to distinguish it from '$\omega$fr' which is the angular frequency of the swing (wherein $\omega$fr equals $2\pi f$) and 'm' is the effective mass of the club as defined above. Thus, the invention provides a connection between the ability of the player to swing the club and the stiffness of the club that should be swung by the player. The major point is that the stiffness of the club should be such that it will allow the shaft to return to the straight position from the position of maximum deflection in the time it takes the golfer to go from this position of maximum deflection to the impact position. A further point is that, when the shaft bends, energy is stored and when the club straightens again this energy must be given up. Thus, if the position where the club returns to the straight position coincides with the impact position this implies that part of the energy deflecting the shaft must be put into the force propelling the ball thus contributing to the efficiency of the swing.

An embodiment of the invention will now be described, by way of example, with reference to the accompanying drawings, in which.

Figure 4:
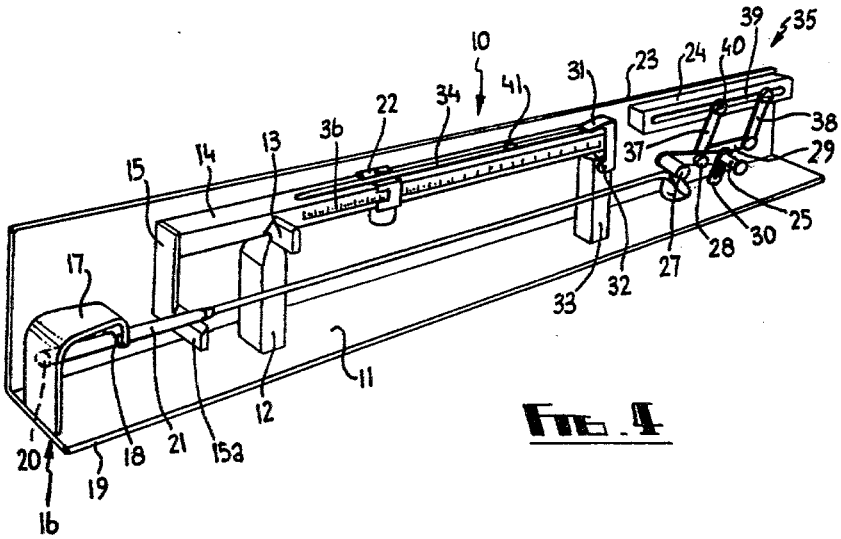
Figure 4A:
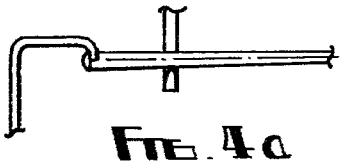
Figure 4B:
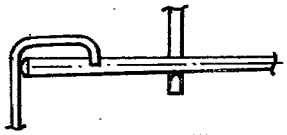
Figure 5:
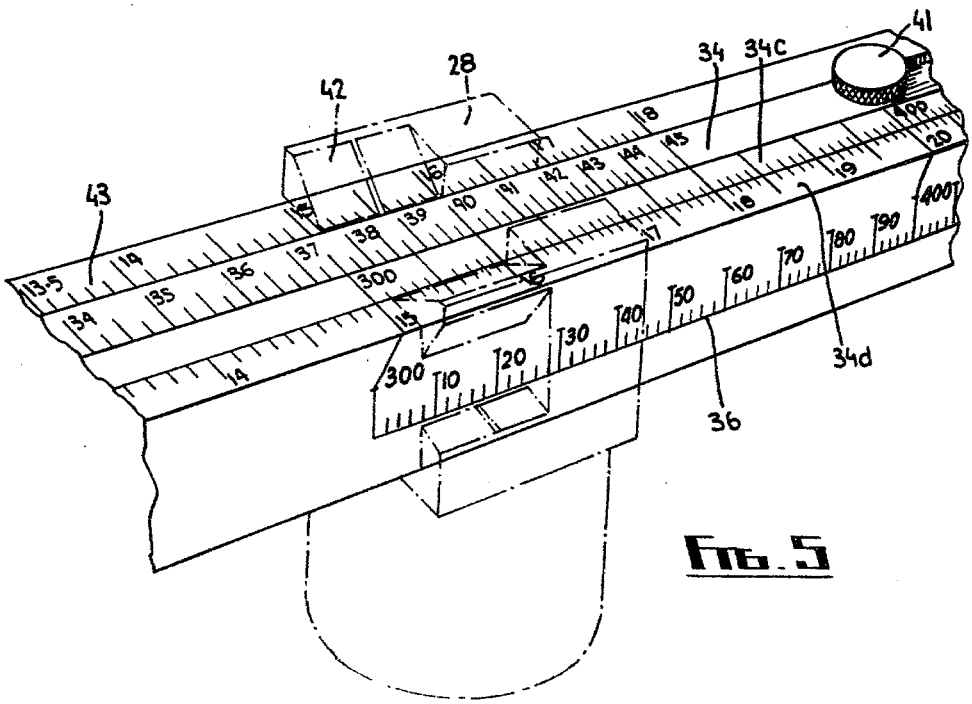
Figure 6:
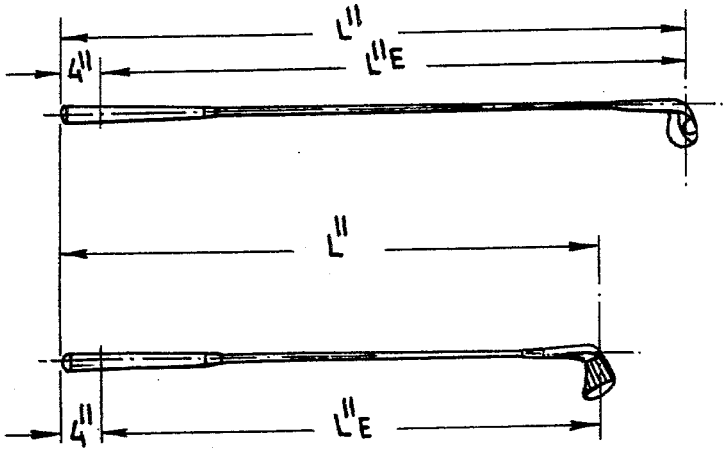

FIGS. 4, 4*a* and 4*b* are views of apparatus for obtaining SWING INDEX according to the invention;

FIG. 5 is a view of the scales on the apparatus for determining the various quantities associated with the invention; and FIG. 6 is a table of club characteristics for clubs made in accordance with the invention.

Figure 1:
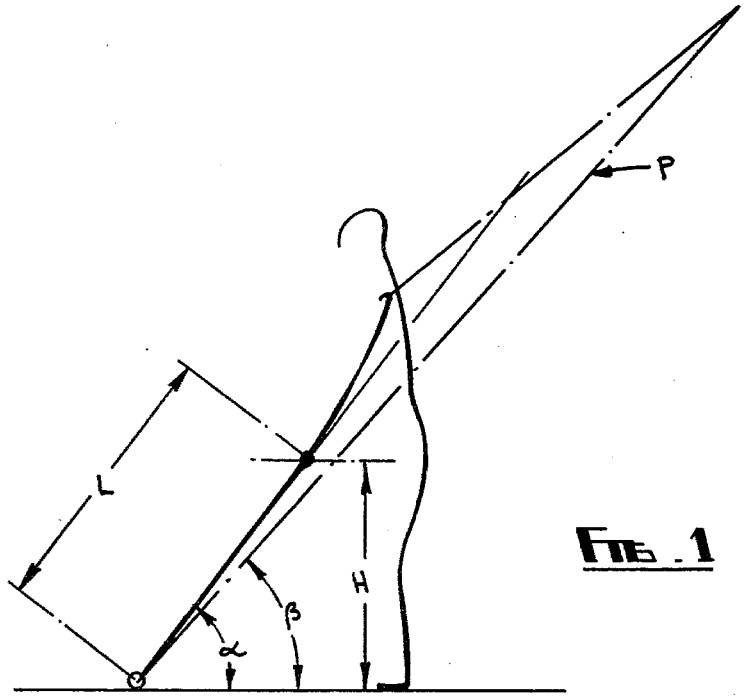
FIG. 1 is a diagrammatic illustration of a golfer in the address position.

Referring now to the drawings, FIG. 1 shows a diagrammatic representation of a golfer in the address position. The golfer's posture in this position, that is whether he tends to crouch over the ball or whether he stands very erect, coupled with the golfer's swing plane P will affect the height of the golfer's hands at address. This height or length is designated H in FIG. 1 and a maximum and minimum height H of a golfer can be established for the range of clubs from, say the driver to the No. 10 iron. Thus, a vertical range of the H distances or hand heights for the clubs in a set of clubs can be established. Taking into consideration of Nos. 1 to 7 woods and Nos. 1 to 10 for the irons the increments between clubs will be the golfer's H distance range, i.e. the vertical hand height range defined by the differences between the maximum and minimum height H aforesaid, divided by sixteen. Thereafter, a standard lie angle $\alpha$ for each increment can be assumed and since sine $\alpha=H/L$ the length L which will determine the shaft length best suited to a particular golfer can be established.

Figure 2:
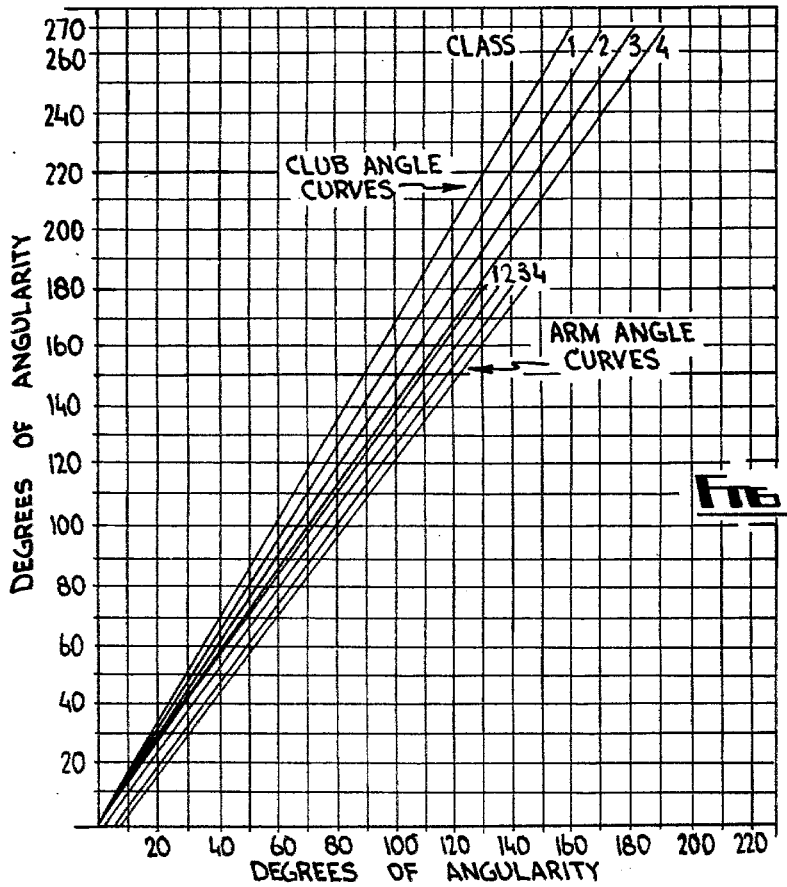
FIG. 2 is a graph of arm and club angles for the range of golfers considered.
Figure 3:
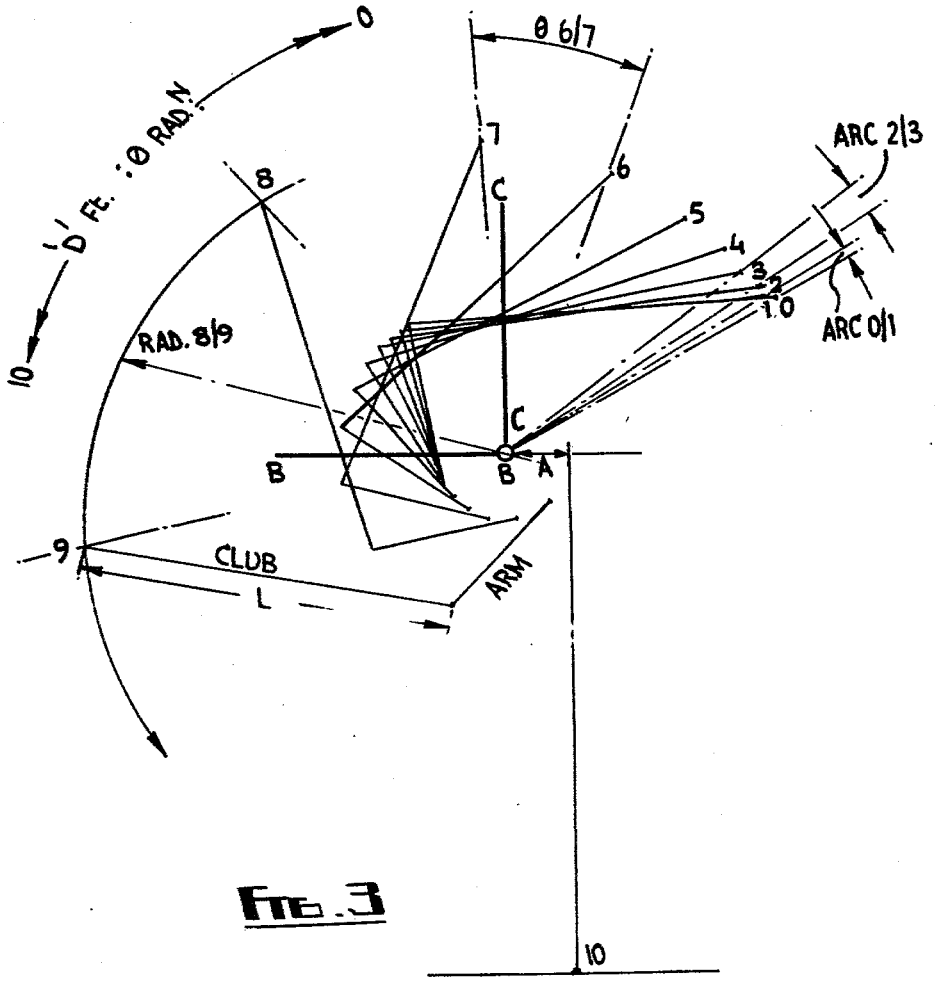
FIG. 3 is a swing pattern or geometry derived from the graphs of FIG. 2.

FIG. 2 shows a graph of arm and club angles which has been compiled using photographs of golfers of different standards and categorised in four groups as previously described and which form the basis for developing the golfer's swing pattern. Having decided the standard or class of golfer involved a chosen number of angle positions can be read off the graph for both arm and club. This procedure is carried out starting with an arm angle of 180° on the vertical scale plotting that point on the appropriate curve and reading the next angle from the horizontal scale, for example, for a class 2 golfer 135°. This latter angle is then selected on the vertical scale plotted on the curve and a third angle obtained from the horizontal scale, in this case 100° and so on until say ten angles have been obtained. The same procedure is then carried out for club angles starting from 270° and using the club angle curves. Thereafter by establishing the golfer's shoulder width and arm length the swing pattern of FIG. 3 is developed to scale from the list of arm and club angles as follows, for convenience the clubhead positions at each angle have been numbered 1 to 10. Assuming positions 8, 9 and 10 to have arm angles of 100, 135 and 180 degrees and club angles of 107, 170 and 270 degrees, respectively, the first arm angle is drawn in by positioning the upper part of the scaled arm radius on the circle with radius A representing the shoulder width and at an angle of 180° measured anti-clockwise from the line B—B around the centre O of the shoulder circle. The arm length is then drawn tangential to the shoulder circle at that point and to length at the correct scale. Similarly for position 9, the angle 135° is measured anti-clockwise from B—B and positioned tangential to the shoulder circle and this procedure is carried out for each of the ten arm angles. The club positions are then found using the corresponding club angles and by marking out a line tangential to a point on the shoulder circle measured anti-clockwise from the vertical line C—C by the club angle. The clubhead position at the point being found by drawing a parallel line through the end of the arm line of a length L measured from the end of the corresponding arm line. By repeating the above exercise the swing pattern as shown in FIG. 3 can be built up and from the pattern it is possible to obtain the linear distance the clubhead travels from the start of the downswing to impact. This is designated 'D' feet and can be obtained by simply scaling the incremental arcuate distances between the points 0 to 1, 1 to 2, 2 to 3 and so on. Alternatively, the distance D can be calculated by setting out the average radii between the angular positions and applying the formula arc $=r_1\theta^1$ etc., where arc equals the incremental distances between the points; $r_1$ is the average radius between the points; and $\theta$ is the angle in radians between positions or points 0–1, 1–2, 2–3 and so on. The incremental distances are then added to give the overall linear distance D feet and angular distance $\theta$ travelled by the clubhead. It should be appreciated that a correcting factor which is dependent on the cosine of the angle $\beta$ of the swing plane P to the vertical is applied to these radii to give the true lengths.

Having obtained the total distance D travelled by the clubhead an average radius or lever length R feet can be obtained from the formula: $R=D/\theta$. It is now necessary to relate the distance travelled by the clubhead to a time element or period and this is done, firstly, by measuring the elapsed time Te it takes for the golfer to go from the top of his swing to impact, i.e. from point 0 to point 10. This can be done conveniently by several methods. For example, it can be measured simply by a visual check with a very accurate stop-watch. Alternatively, an estimate can be made using a series of photographs where the time rate of the different frames is known. A further alternative comprises the use of two photo-cells a known distance apart or a velocity meter or anemometer attached to the clubhead.

Moreover, a hypothetical unit time Tu can be selected being the optimum Te for a class 1 golfer having an impact velocity of 175 ft./sec., i.e. 0.62 secs. divided by the number of increments giving Tu equal to 0.062 secs. The optimum figures have been found from field tests.

Thereafter by using the formula $V_1=2\ D/Tu-V_0$ it is possible to work out the instantaneous velocities based on distance travelled between the points 0–1, 1–2, 2–3 and so on up to position 10 which is the impact position. In this equation $V_1$ is the final velocity, say at point 2, $V_0$ would be the velocity at position 1, Tu equals 0.062 secs. and D is the distance in feet between positions 1 and 2. This procedure is carried out for each position and therefore it is possible to arrive at a figure for the impact velocity and a typical value for this would be of the order of 170 ft. per sec. Now having obtained the impact velocity and knowing the overall distance travelled of D feet an average time Ta for the downswing can be obtained and this time Ta according to the theory is found to be equal to the time period T previously mentioned. Thus, with an impact velocity of 170 ft. per sec. and a distance travelled D equal to say 18.817 ft. Ta equals 2 times 18.817 divided by 170 minus zero, and Ta is found to be 0.222 secs. Also knowing the average radius or lever length 'R' feet the angular velocity can be found from $V=R\omega$ and the angular frequency $\omega fr$ can be found from $\omega fr=2\pi/Ta$. Following this the stiffness factor 'k' for the required shaft is found from the relationship $K=\omega fr^2m$ where m is the effective mass of the club as previously defined. From the above it will be seen that a relationship can be established between Tu which is one tenth of the optimum time T for the downswing of a class 1 golfer, Ta which is a theoretical time calculated for a particular class of player from the swing geometry and Te is the actual time for the downswing of that player. Care must be taken when evaluating the above relationships to ensure consistency of units. For example, 'k' will be in units of force per unit length, $\omega$ and $\omega fr$ in rads per sec. and mass in (lbs $sec^2$)/ft×2) and so on.

Once the linear velocity of the clubhead at impact and its related angular velocity $\omega$ is found, this angular velocity and, in turn, its associated angular frequency $\omega fr$ will remain constant from club to club in a matched set. Therefore, once $\omega$ has been found for one club it remains the same for each club and since $\omega fr$ remains the same also, the 'k' factor for each club will really vary according to the effective mass of the club. However, since the total mass of the club is basically made up of the grip weight, shaft weight and head weight it can readily be seen that the combination of head weight and shaft weight can be varied to alter the 'k' factor. Alternatively, it can be said head weight and shaft weight can be varied to give a desired 'k' factor. Thus, from the above any club can be produced with a 'k' factor best suited to the individual player and clubs can be calibrated accordingly.

Furthermore, clubs can be calibrated according to the invention by means of a quantity referred to herein as the SWING INDEX MOMENT of a golf club, which is the product of the total weight of the club multiplied by its effective length. During the swing the forces acting on the golf club are generated by the golfer, himself, whose capability to generate such forces must remain substantially constant from club to club. This being so it follows that a player must be able to provide a constancy of force to act on any one club. Therefore, there must be a combination of shaft length and head weight which will provide optimum results for the force any one player is capable of generating. According to the invention optimum results will be obtained by evaluating or determining the SWING INDEX MOMENT and basing the club design on this. Once the SWING INDEX MOMENT has been determined for one club it remains, according to the invention, the same for each club in a matching set.

In addition to this it is well known that manufacturers are continually seeking ways of reducing shaft weight. The underlying theory behind this being the more weight that can be put into the head at the expense of the shaft the better, assuming the overall weight remains substantially the same. Indeed the ideal case would appear to be a weightless shaft so that all the weight being swung by the golfer would be concentrated in the head and hence maximum energy would be imparted to the ball. Clearly, a weightless shaft is an impossibility, nevertheless, according to the invention the SWING INDEX MOMENT simulates such an ideal situation and the apparatus provided can be used to assess a golf club in terms of this SWING INDEX MOMENT. For example, such an ideal moment would pertain if all the weight of the golf club, that is, the total weight of the golf club acted, not at the club centre of gravity, but at the centre of the gravity of the club head. The apparatus described herein measures the SWING INDEX MOMENT in terms of a static moment of weight which is taken about a point on the club grip portion substantially coincidental with the centre of the point of the golfer's grip. In most clubs this point is near enough to four inches from the free end or butt end of the grip portion of the shaft. Taking moments about this point means also, that the weight of the grip member can be left out of any subsequent moment calculations.

The apparatus generally designated 10 in FIG. 4 comprises a base member 11 carrying thereon an upright support 12 containing a knife edge support or fulcrum 13. A lever arm 14 rests on the upper portion of the upright 12 and is balanced thereon. An anvil member 15 is attached to the lever arm 14 and projects downwardly to form an L-shaped arrangement with the lever arm 14 and has a portion 15*a* laterally offset to support a golf club 21 as shown in the drawing. A further upright support member 16 is carried by the base member 11 and is crooked over as at 17 so that a downward projecting portion 18 can co-operate with the anvil member 15*a* and retain a golf club 21 placed therebetween. An alternative would be to omit the offset portion 15*a* and make the upright support 12 in the form of a U-shape so that the lever arm 14 and the golf club 21 could be accommodated within the slot of the U-shape. This way the lever arm 14 and the golf club would be substantially in line. Of course in this case, the downwardly projecting portion 15 would also require to be made with a slot to accommodate the golf club. It is important to note that the longitudinal distance of the portion 18 from the back 19 of the upright 16 is such that allows the static moment, referred to as Ms, of the golf club to be measured at a point substantially four inches from the free end 20 of the golf club 21 placed in the apparatus.

A movable weight 22 is carried by the lever arm 14 and can be moved to counter act the static moment of weight Ms exerted by the club when it is placed in the apparatus. A portion of the knife-edge fulcrum 13 projecting outwardly of the support 12 can be used to balance the golf club and hence find the centre of gravity length Lcg. To assist in guiding the lever arm 14 a catch 31 hinged at 32 to an upright 33 may be used. This may also be used to immobilise the lever arm when the apparatus is not in use or is being transported. The scale 36 formed on the lever arm 14 is graduated to register moment readings in oz ins. units and by suitable manipulation of a sliding scale 34, movably attached to the lever arm 14, the moment of weight readings Ms may be converted to the appropriate SWING INDEX MOMENT reading Msi as will be explained later.

The apparatus includes means to assess the stiffness factor 'k' which has to be related to the SWING INDEX MOMENT. This can be done by placing the golf club in position between the anvil member 15*a* and the portion 18 as shown in FIG. 4*a*. The movable weight 22 is then manipulated until the equilibrium position is reached and a first moment reading may be recorded and noted. Thereafter by applying a known load and measuring the deflection or, as preferred herein, by applying a standard deflection and measuring the moment reading on the scale, the difference between the noted first reading and the reading of the second applied moment can be obtained. Clearly the difference between these readings is a measure of the shaft flexibility since this amount of moment is induced by the shaft bending or yielding the amount of the applied standard deflection. Thus, it can be shown, for example, where the first reading equalled 390 oz ins. and the second reading equalled 1031 oz ins. the difference would be 641 oz ins, and assuming this has been applied at a moment arm of 43 ins, the appropriate 'k' factor would be 641 divided by 43 which would be 14.90 oz per inch or 11.18 lbs per foot.

The means to apply the standard deflection comprises a lever/cam arrangement 35 carried by a side wall member 23 attached to the base member 11. This lever/cam assembly is removably retained on a slideway 24 and hence the apparatus can accommodate different length clubs. In greater detail the lever/cam assembly is assembled to the slideway 24 by means of a parallel link assembly comprising arms 37, 38 and link 39. The end of arm 37 is releasably connected with slideway 24 by means of a screwed member 40. Arm 38 is also arranged to be movably attached to the slideway 24. A lever arm 25 carries a roller member 27 which bears on the club head, and the roller member 27 is removably retained to the link 39 by means of a screwed connecting pin 28. By loosening the connection 40 and retaining lever arm 25 in a horizontal position by means of connecting pin 28, the roller member 27 may be brought to bear on the club head by the adjustment of the parallelogram linkage. Thereafter the setting is secured by the tightening of connection 40. Deflection is applied by moving lever arm 25 with the attached roller member 27 through a predetermined arc governed by the setting on an adjustable quadrant 30. The lever arm is then secured by tightening the connector pin 28.

The apparatus incorporates various scales, as shown in FIG. 5, to assist in determining various quantities, such as Ms, Msi, the 'k' factor and also the weight of the golf club. The Ms reading will, of course, be obtained by placing the golf club in the apparatus as shown in FIG. 4*b*, moving the weight 22 to re-establish equilibrium and the static moment Ms will be obtained by direct read-out on scale 36 formed on the front side of the lever arm 14. The SWING INDEX MOMENT can then be obtained from this figure by combined use of the weight 22 acting also as a cursor as well as a balance weight, and with a scale 34 graduated in inches and representing club length movable within lever arm 14 and lockable by means of knurled nut 41. It will be seen that the weight/cursor member 22 has openings or panels of clear plastics material or other transparent material at the side and top to facilitate readings. FIG. 5 shows the weight/cursor member 22 in chain-dot and also, in position on the lever arm 14. The known Ms reading is located on the scale 36 and followed up on to scale 34*c* and the cursor set against this value. The sliding scale 34 is then positioned until the centre of gravity length Lcg is aligned with the cursor and the Ms reading. Thereafter, the cursor is moved until it is set or registered with the effective length Le, i.e. the overall length minus 4", shown also on scale 34. The reading then being shown on scale 34*c* is the moment Msi in oz ins. units.

The 'k' factor can be obtained as follows. The difference between the first and second moment readings previously recorded, which can for convenience be called the 'k' moment is located on log scale 34*c* and the cursor member 22 brought into alignment with it. The centre scale 34 is moved until the moment arm length at which the 'k' moment had been applied registers with the cursor. The reading on a scale 43 appearing against the numeral 20 of scale 34 will then give the 'k' factor in oz per inch. Knowing the SWING INDEX MOMENT, this may be set on scale 34*c* and the cursor aligned with it. Thereafter if the scale 34 is moved so that the effective length Le registers with the cursor, the weight of the golf club may be read off on a scale 34*d* calibrated in ounces under the numeral 20 of scale 34. It should be noted that with the exception of scale 36 which registers Ms and Msi the scales are all log-log. In addition it will be clear that it would be possible to provide these scales separately from the apparatus in the form of a slide rule type tool. In this case the apparatus would be provided only with the moment scale 36. It will be clear from the above that once the appropriate 'k' factor has been identified for an individual by carrying out the various procedures described previously it is then necessary to select a suitable shaft or make up a shaft from basic tubular material to have the correct 'k' factor. In this case the apparatus can then be used to test the shaft has the correct 'k' factor. Alternatively the apparatus may be used to test an existing club or shaft where it is desired to match a club or shaft or where it is desired to change from one flexibility to another. Moreover, clubs may be calibrated in accordance with their SWING INDEX MOMENT, all clubs in a set having the same SWING INDEX MOMENT.

FIG. 6 shows details of club characteristics tabulated for a set of clubs with a SWING INDEX of 505. These are standardised to facilitate the method on the assumption that all iron shafts will enter into the head a distance of approximately 1¼ inches. With wooden clubs the assumption is made that the centre of gravity of the club head coincides with the heel of the club. From the table it will be seen that the SWING INDEX is constant throughout the set whereas the static moment Ms varies and increases in value from the No. 1 wood to the No. 4 wood and from the No. 3 iron to the No. 9 iron, pitching wedge and sand iron. It should be noted that although the No. 2 wood and No. 2 iron have been omitted, the other clubs, nevertheless, are in their correct sequence. These results can be graphed or otherwise made to show the relationship between the various parameters and families of curves can be produced facilitating club design and shaft selection. Moreover, in order to match the SWING INDEX to a player the player need only select the club of his existing collection which has the best feel, the SWING INDEX of that club can be determined and the other clubs of his set selected from clubs all having the same SWING INDEX.

I claim:

1. A matched set of golf clubs designed to suit a particular golfer having a particular swing including a predetermined swing velocity having a constant angular velocity and a constant angular frequency for each club of the set of clubs, each of said golf clubs having a grip portion, a shaft of different length, a club head affixed to each of said shafts and possessing a unique loft angle, an effective length of the golf club measured from an identical preselected point on said grip portion, a total weight, whereby the product of said effective length multiplied by said total weight is substantially the same for each club in the set, and wherein each shaft of said set has a stiffness factor differing from club to club in the set and being mathematically functionally related to said swing velocity such that the stiffness of each shaft permits the shaft to return to substantially straight condition from a condition of maximum shaft deflection in the time it takes the golfer, during a downswing, to swing the club from the position of maximum deflection to impact position.

2. A set of golf clubs according to claim 1 wherein said speed of swing is expressed in terms of a linear frequency and wherein the stiffness factor is the product of four times $\pi$ squared times the linear frequency squared times the effective mass of the golf club.

3. A set of golf clubs according to claim 2 wherein the frequency is equal to the reciprocal of the average time of the downswing of said swing.

4. A set of golf clubs according to claim 1 wherein the speed of swing is expressed in terms of an angular frequency and wherein the stiffness factor is the product of the angular frequency squared times the effective mass of the golf club.

5. A set of golf clubs according to claim 1 wherein the length of each club is a function of the sine of its lie angle and an associated vertical hand height determined when a golfer is in the address position.

6. A set of golf clubs according to claim 5 wherein the incremental length differences between clubs is a function of a vertical hand height range divided by the number of golf clubs in the set.

7. A set of golf clubs according to claim 1 wherein the incremental length differences between clubs is determined by dividing the vertical hand height range; measured with the hands in the address position, by sixteen, and wherein the length of each club is a function of the sine of its lie angle and of a vertical hand height selected in accordance with said hand height range.

8. A method of producing a custom designed, matched set of golf clubs suited to a particular golfer having a particular swing including a predetermined swing velocity having a constant angular velocity and a constant angular frequency for each club of the set, each of said golf clubs having a grip portion, a shaft of different length, a club head affixed to each of said shafts and possessing a unique loft angle, an effective length of the golf club measured from an identical preselected point on said grip portion, a total weight, whereby the product of said effective length multiplied by said total weight is substantially the same for each club in the set, the steps comprising:

(a) proving the golfer with a golf club wherein the shaft length is calculated according to the equation $L=H/\text{sine}\ \alpha$, in which L denotes the length of the club, H denotes the vertical hand height measured when the golfer is in the address position and $\alpha$ denotes a standard lie angle;

(b) establishing a chart of arm and club angles for a range of golfers;

(c) developing the swing geometry for the particular golfer according to said established chart by selecting the appropriate arm and club angles;

(d) developing the golfer's particular swing pattern from the values selected in step (c) including finding the linear distance moved by the head of the club and the average radius of the path of the club head during the downswing;

(e) determining the downswing time;

(f) calculating the impact velocity of the club head;

(g) calculating the angular velocity and the angular frequency of the downswing;

(h) calculating the stiffness factor for the club according to the equation $K=\omega fr^2m$, in which k denotes the stiffness factor, $\omega fr$ denotes the angular frequency of the club, r denotes said average radius, and m denotes the effective mass of the club;

(i) selecting a shaft whose weight and stiffness factor are in accord with the effective mass and the stiffness factor in step (h) so that the stiffness permits the shaft to return to substantially straight condition from a condition of maximum shaft deflection in the time it takes the golfer, during the downswing, to swing the club from the position of maximum deflection to the impact position; and (j) repeating steps (h) and (i) for each club in said set.

9. A method of producing a custom designed, matched set of golf clubs suited to a particular golfer having a particular swing including a predetermined swing velocity having a constant angular velocity and a constant angular frequency for each club of the set, each of said golf clubs having a grip portion, a shaft of different length, a club head affixed to each of said shafts and possessing a unique loft angle, an effective length of the golf club measured from an identical preselected point on said grip portion, a total weight, whereby the product of said effective length multiplied by said total weight is substantially the same for each club in the set, the steps comprising:

(a) providing the golfer with a golf club wherein the shaft length is calculated according to the equation $L=H/\text{sine}\ \alpha$, in which L denotes the length of the club, H denotes the vertical hand height measured when the golfer is in the address position and $\alpha$ denotes a standard lie angle;

(b) establishing a chart of arm and club angles for a range of golfers;

(c) developing the swing geometry for the particular golfer according to said established chart by selecting the appropriate arm and club angles;

(d) developing the golfer's particular swing pattern from the values selected in step (c) including finding the linear distance moved by the head of the club and the average radius of the path of the club head during the downswing;

(e) determining the downswing time;

(f) calculating the impact velocity of the club head;

(g) calculating the angular velocity and the angular frequency of the downswing;

(h) calculating the stiffness factor for the club according to the equation $k=4\pi^2f^2m$, in which k denotes the stiffness factor, f denotes the linear frequency of the club, and m denotes the effective mass of the club;

(i) selecting a shaft whose weight and stiffness factor are in accord with the effective mass and the stiffness factor in step (h) so that the stiffness permits the shaft to return to substantially straight condition from a condition of maximum shaft deflection in the time it takes the golfer, during the downswing, to swing the club from the position of maximum deflection to the impact position; and (j) repeating steps (h) and (i) for each club in said set.

* * * * *